US010982556B2

(12) United States Patent
Kitamura

(10) Patent No.: US 10,982,556 B2
(45) Date of Patent: Apr. 20, 2021

(54) APPLICATION JIG AND METHOD FOR MANUFACTURING ROTOR BLADES

(71) Applicant: MITSUBISHI HITACHI POWER SYSTEMS, LTD., Yokohama (JP)

(72) Inventor: Kazuyoshi Kitamura, Kanagawa (JP)

(73) Assignee: MITSUBISHI POWER, LTD., Yokohama (JP)

( * ) Notice: Subject to any disclaimer, the term of this patent is extended or adjusted under 35 U.S.C. 154(b) by 0 days.

(21) Appl. No.: 16/635,030

(22) PCT Filed: Aug. 9, 2018

(86) PCT No.: PCT/JP2018/029880
§ 371 (c)(1),
(2) Date: Jan. 29, 2020

(87) PCT Pub. No.: WO2019/054103
PCT Pub. Date: Mar. 21, 2019

(65) Prior Publication Data

US 2020/0378266 A1 Dec. 3, 2020

(30) Foreign Application Priority Data

Sep. 15, 2017 (JP) ..... JP2017-178134

(51) Int. Cl.
*F01D 5/28* (2006.01)
*F01D 25/00* (2006.01)
*F01D 5/14* (2006.01)

(52) U.S. Cl.
CPC ..... *F01D 5/286* (2013.01); *F01D 25/00* (2013.01); *F01D 5/147* (2013.01); *F05D 2220/31* (2013.01); *F05D 2240/303* (2013.01); *F05D 2240/307* (2013.01)

(58) Field of Classification Search
CPC ..... F01D 5/286; F01D 25/00; F01D 5/147; F01D 5/28; F05D 2220/31; F05D 2240/303; F05D 2240/307
See application file for complete search history.

(56) References Cited

FOREIGN PATENT DOCUMENTS

JP 2005-188481 A 7/2005

OTHER PUBLICATIONS

International Search Report dated Oct. 30, 2018, issued in counterpart International Application No. PCT/JP2018/029880. (2 pages).

*Primary Examiner* — Jacob M Amick
*Assistant Examiner* — Charles Brauch
(74) *Attorney, Agent, or Firm* — Westerman, Hattori, Daniels & Adrian, LLP

(57) ABSTRACT

An application jig is used when an erosion shield member is applied to a rotor blade member. The application jig includes a body section disposed on a back side of the rotor blade member; a first pressing section provided in the body section and pressing an erosion shield member to be placed at a leading edge of the rotor blade member from the back side; a second pressing section supported by the body section and pressing a trailing edge of the rotor blade member from the back side; and a third pressing section supported by the body section. The third pressing section is disposed to bypass the trailing edge from the back side to a belly side thereof, is pivotable around a pivot shaft provided in the body section, and presses a portion between the leading and trailing edges in a pivoting direction from the belly side.

8 Claims, 9 Drawing Sheets

APPLICATION JIG AND METHOD FOR MANUFACTURING ROTOR BLADES

TECHNICAL FIELD

The present invention relates to an application jig and a method for manufacturing rotor blades.

BACKGROUND ART

Rotor blades used for steam turbines are rotated within a path along which steam flows. For example, the steam near the final stage of a low-pressure steam turbine contains fine water droplets. In this case, in a rotor blade, a blade tip leading edge will be worn by erosion due to high-speed collision of the water droplets. As a countermeasure against such erosion, there is a method of forming an erosion shield at the tip leading edge of the rotor blade.

In a case where the erosion shield is formed at the tip leading edge of the rotor blade, heat welding is performed, for example, by disposing an erosion shield member, which constitutes the erosion shield, at a tip leading edge of a rotor blade member, and by heating the leading edge of the rotor blade member from the belly side using a heating instrument or the like while the erosion shield member is pressed against the leading edge of a rotor blade member from the back side by using a jig. In this case, for example, the configuration of PTL 1 is known as the jig that presses down the leading edge of the rotor blade member from the back side.

CITATION LIST

Patent Literature

[PTL 1] Japanese Unexamined Patent Application Publication No. 2005-188481

SUMMARY OF INVENTION

Technical Problem

The jig according to PTL 1 has a configuration in which the leading edge of the rotor blade member is also pressed from the belly side. Therefore, when the leading edge of the rotor blade member is heated from the belly side, it is necessary to dispose the heating instrument while avoiding the jig to perform the heating, and improvements are required in terms of workability.

The invention has been made in view of the above, and an object thereof is to provide an application jig and a method for manufacturing rotor blades capable of improving workability.

Solution to Problem

An application jig according to the invention is an application jig used when an erosion shield member is applied to a rotor blade member, and includes a body section that is disposed on a back side of the rotor blade member; a first pressing section that is provided in the body section and presses an erosion shield member to be placed at a leading edge of the rotor blade member from the back side of the rotor blade member; a second pressing section that is supported by the body section and presses a trailing edge of the rotor blade member from the back side; and a third pressing section that is supported by the body section, is disposed to bypass the trailing edge from the back side of the rotor blade member to a belly side thereof, is pivotable around a pivot shaft provided in the body section, and presses a portion between the leading edge and the trailing edge of the rotor blade member from the belly side.

Therefore, since the first pressing section presses the leading edge from the back side and the third pressing section is disposed to bypass the trailing edge from the back side of the rotor blade member to the belly side, the belly side of the leading edge in which the erosion shield member is disposed is not blocked by the jig. Accordingly, the workability when the leading edge is heated using a heating instrument or the like can be improved. Additionally, as the third pressing section presses the rotor blade member from the belly side, the rotor blade member can be sandwiched and held from the belly side and the back side between the first pressing section and the second pressing section that press the rotor blade member from the back side. In this case, since the third pressing section presses the portion between the leading edge and the trailing edge of the rotor blade member from the belly side, the rotor blade member can be pressed in a balanced manner by minimum pressing parts. Moreover, since the third pressing section is pivotable around the pivot shaft provided in the body section and performs pressing in a pivoting direction, the rotor blade member having a curved surface can also be reliably and easily pressed in accordance with the position of the curved surface.

Additionally, in the application jig, the first pressing section may be supported to be movable in a blade width direction of the rotor blade member.

Therefore, a rotor blade member having different blade widths can also be used.

Additionally, the above application jig may further include a pressing force application portion that is provided in the body section and applies a pressing force to the third pressing section.

Therefore, pressing forces can be efficiently generated in the first pressing section, the second pressing section, and the third pressing section by applying the pressing force to the third pressing section.

Additionally, in the above-mentioned application jig, the pressing force application portion may be an air cylinder.

Therefore, the control of the pressing forces can be stably performed.

Additionally, in the above-mentioned application jig, the third pressing section may be a circular-arc member.

Therefore, since the shape of the third pressing section is a circular-arc shape corresponded to a track during pivoting, a space where the third pressing section pivots can be stopped.

Additionally, the above-mentioned application jig may further include a fourth pressing section that is provided in the second pressing section, presses the trailing edge of the rotor blade member from the belly side, and sandwiches the trailing edge between the fourth pressing section and the second pressing section.

Therefore, the rotor blade member can be stably held.

Additionally, in the above-mentioned application jig, the second pressing section has a guide portion that guides the pivoting of the third pressing section.

Therefore, the pivoting of the third pressing section can be stabilized, and the pressing forces that press the rotor blade member can be stabilized.

A method for manufacturing rotor blades according to the invention is a method for manufacturing rotor blades, using the above application jig, and includes a step of supporting the trailing edge of the rotor blade member from the back side with the second pressing section; a step of placing the erosion shield member at the leading edge of the rotor blade member and supporting the erosion shield member from the back side of the rotor blade member with the first pressing section; a step of pressing the rotor blade member in a sandwiched state together with the first pressing section and the second pressing section by pressing the portion between the leading edge and the trailing edge of the rotor blade member from the belly side with the third pressing section in a state where the rotor blade member is supported by the first pressing section and the second pressing section; and a step of applying the erosion shield member to the leading edge of the rotor blade member by heating the leading edge of the rotor blade member from the belly side in a state where the rotor blade member is pressed by the first pressing section, the second pressing section, and the third pressing section.

Therefore, the belly side of the leading edge in which the erosion shield member is disposed is not blocked by the jig. Accordingly, the workability when the leading edge is heated using a heating instrument or the like can be improved.

Advantageous Effects of Invention

According to the invention, the application jig and the method for manufacturing rotor blades capable of improving workability are provided.

DESCRIPTION OF EMBODIMENTS

Hereinafter, an embodiment of an application jig and a method for manufacturing rotor blades according to the invention will be described with reference to the drawings. In addition, this invention is not limited to this embodiment. Additionally, components that can be easily replaced by those skilled in the art or substantially the same components are included in components in the following embodiment.

Figure 1:
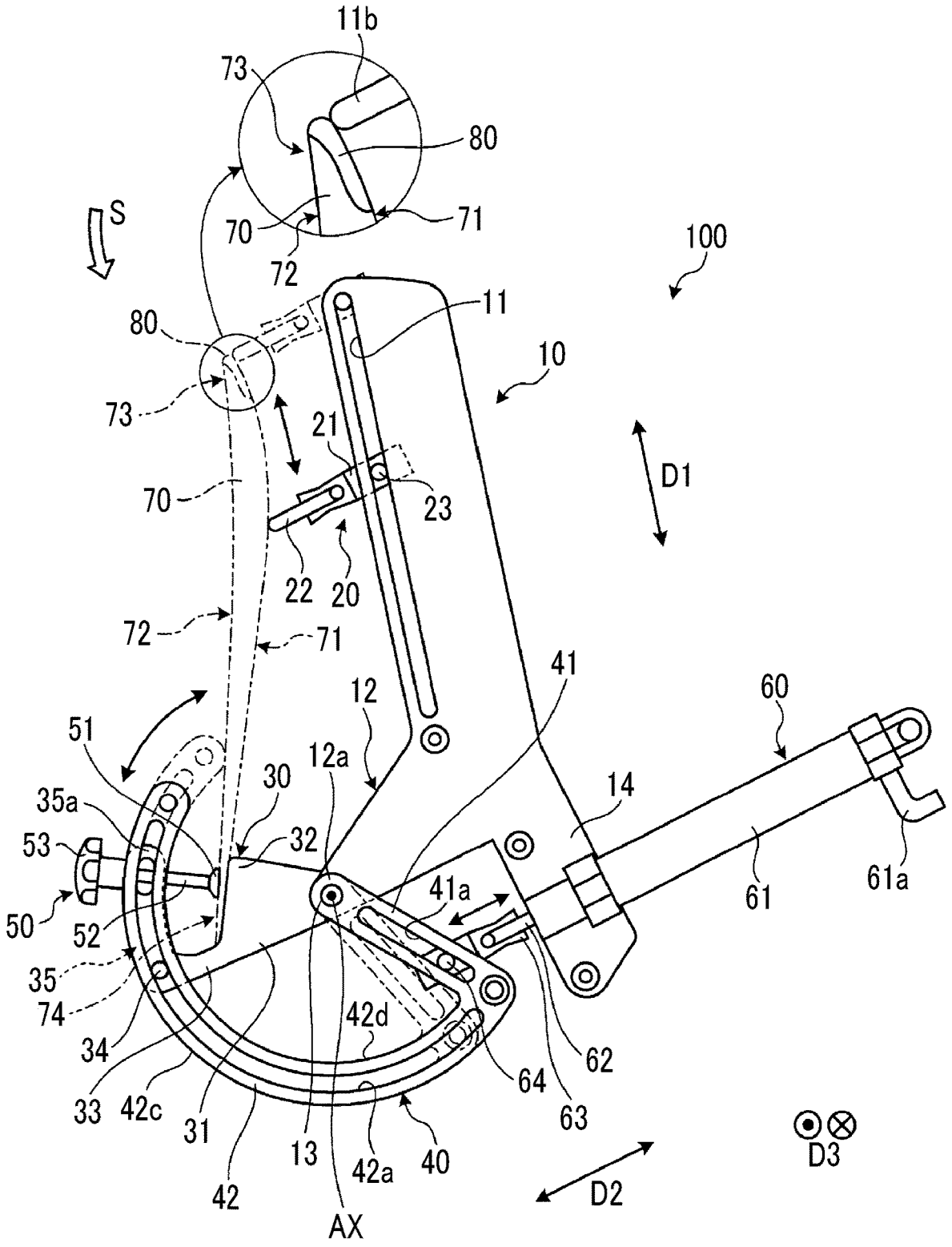
FIG. 1 is a view illustrating an example of an application jig according to the present embodiment.

FIG. 1 is a view illustrating an example of an application jig 100 according to the present embodiment. The application jig 100 illustrated in FIG. 1 is used when a rotor blade 75 is manufactured by applying an erosion shield member 80 to a rotor blade member 70. A plurality of the application jigs 100 may be used side by side in a blade length direction with respect to one rotor blade member 70. As illustrated in FIG. 1, the application jig 100 includes a body section 10, a first pressing section 20, a second pressing section 30, a third pressing section 40, a fourth pressing section 50, and a pressing force application portion 60.

The body section 10 is disposed on a back side with respect to the rotor blade member 70 having a curved surface. The body section 10 is formed in a substantially oblong or substantially parallelogram-like plate shape, for example, with metal or the like. Hereinafter, a longitudinal direction of the body section 10 is defined as a first direction D1, and a transverse direction of the body section 10 is defined as a second direction D2. Additionally, a description will be made with a thickness direction D1 of the body section 10, that is, a direction orthogonal to each of the first direction and the second direction D2 being defined as a third direction D3.

The body section 10 has a guide portion 11, a protrusion portion 12, a pivot shaft 13, and an attachment port 14.

The guide portion 11 guides the first pressing section 20 in the first direction D1. The guide portion 11 is, for example, an elongated hole that extends linearly in the first direction D1. The guide portion 11 is provided through the body section 10 in the third direction D3.

The protrusion portion 12 protrudes from the guide portion 11 to the rotor blade member 70 side in the second direction D2. The protrusion portion 12 has a bearing portion 12*a* that pivotably supports the pivot shaft 13.

The pivot shaft 13 is, for example, cylindrical or columnar, and has a central axis AX disposed parallel to the third direction D3.

The attachment port 14 is disposed at an end portion of the body section 10 in the first direction D1. The pressing force application portion 60 is detachably formed in the attachment port 14.

The first pressing section 20 is formed in the body section 10, and presses the erosion shield member 80 to be placed at a leading edge 73 of the rotor blade member 70 from a back portion 71 side (hereinafter written as a "back side") of the rotor blade member 70. The first pressing section 20 has a base portion 21, an abutment portion 22, and an insertion portion 23.

The base portion 21 supports the insertion portion 23 and the abutment portion 22. The base portion 21 is movable in the first direction D1 along the guide portion 11. The base portion 21 is disposed so as to sandwich the body section 10 in the third direction D3. In FIG. 1, in order to illustrate a positional relationship between the insertion portion 23 and the guide portion 11, illustration of a portion disposed on a front side of the paper surface with respect to the body section 10 is omitted. In addition, the configuration of the base portion 21 is not be limited to the above configuration, and may be other configurations.

The abutment portion 22 abuts against the erosion shield member 80. The abutment portion 22 protrudes from the base portion 21 to the rotor blade member 70 side. A tip portion of the abutment portion 22 in a protruding direction has a rounded shape. The abutment portion 22 abuts against the erosion shield member 80 at the tip portion. In addition, the abutment portion 22 of the first pressing section 20 presses the leading edge 73 of the rotor blade member 70 from the back side with reaction forces against pressing forces of the third pressing section 40 and the fourth pressing section 50 to be described below.

The insertion portion 23 is formed, for example, in a columnar shape or a cylindrical shape, and is formed to such a diameter that the insertion portion is insertable into the above guide portion 11. As the insertion portion 23, for example, a screw member passing through the base portion 21 in the third direction D3 is used. The insertion portion 23 is formed with, for example, a dimension such that the insertion portion passes through the guide portion 11 in the third direction D3. By inserting the insertion portion 23 into the guide portion 11, the insertion portion 23 is guided by the guide portion 11, and is movable in the first direction D1 integrally with the base portion 21.

The first pressing section 20 is optionally changeable in position in the first direction D1 by moving the base portion 21 along the guide portion 11. In addition, a configuration may be adopted in which the protruding direction of the abutment portion 22 is also optionally changeable by rotating the base portion 21 about a central axis of the insertion portion 23. Additionally, a tip of the insertion portion 23 is screw-joined with a nut (not illustrated). By screwing the nut (not illustrated) to the insertion portion 23, the base portion 21 is fixable to the body section 10. In this case, it is possible to fix the position of the first pressing section 20 to the body section 10, and the positional deviation of the first pressing section 20 is suppressed.

Figure 2:
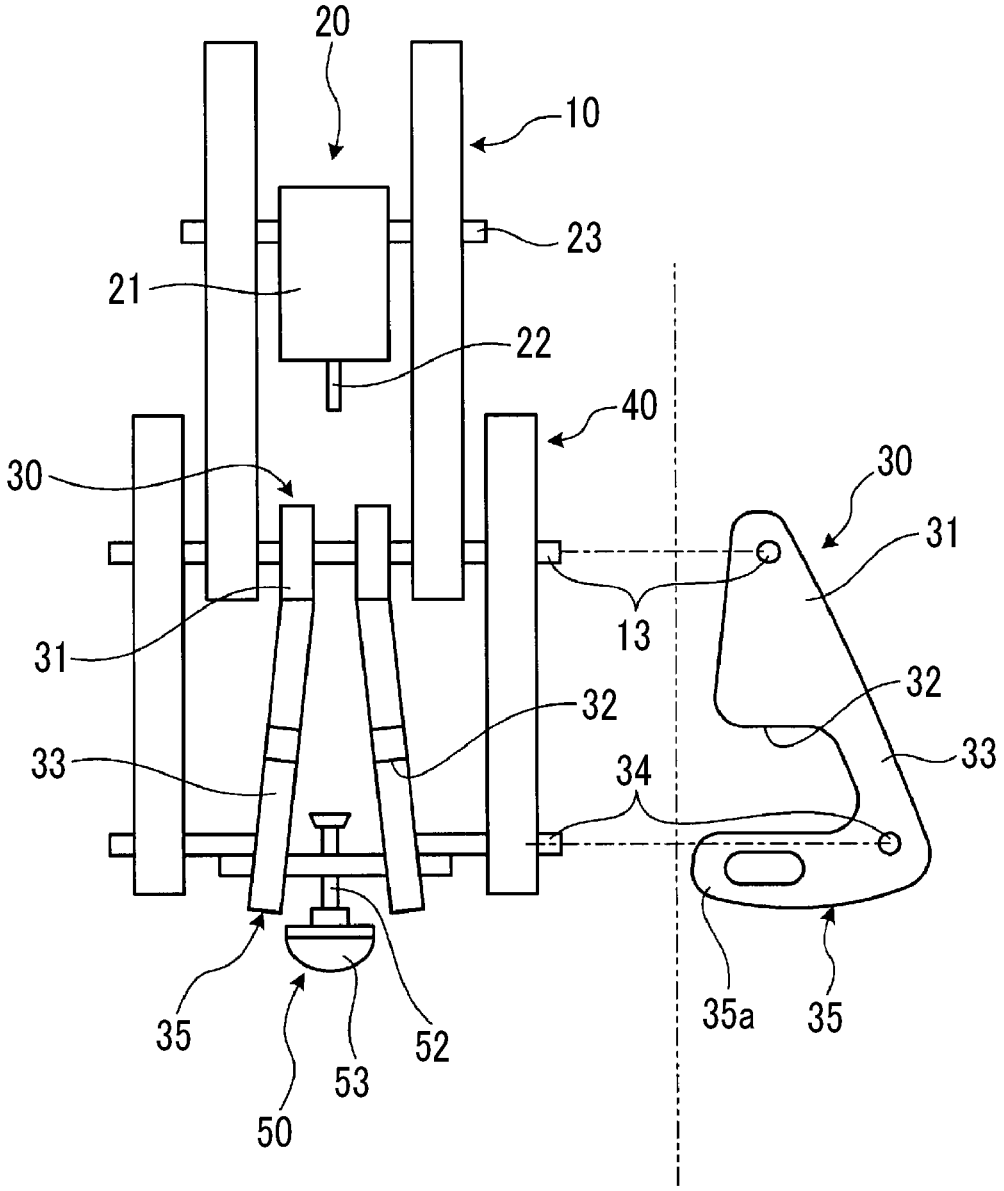
FIG. 2 is a view illustrating an example of the application jig according to the present embodiment and illustrating a state as viewed from the direction of arrow S in FIG. 1.

The second pressing section 30 is supported by the body section 10, and presses a back side of a trailing edge 74 of the rotor blade member 70. The second pressing section 30 is formed at a tip of the protrusion portion 12 in a protruding direction. FIG. 2 is a view illustrating an example of the application jig 100 according to the present embodiment, and illustrates a state as viewed from the direction of arrow S in FIG. 1. In FIG. 2, intervals between respective members are illustrated in an exaggerated manner in order to illustrate an overlapping state as viewed from a direction perpendicular to the paper surface in FIG. 1. Additionally, in FIG. 2, the second pressing section 30 in a state as viewed from the same direction as FIG. 1 is illustrated in contrast in order to easily distinguish positional relationships between the second pressing section 30 and other components. As illustrated in FIGS. 1 and 2, the second pressing section 30 has a coupling portion 31, a back-side supporting portion 32, a butting portion 33, a projection portion 34, and a circular-arc portion 35. The coupling portion 31 is coupled to the protrusion portion 12 of the body section 10 via the pivot shaft 13. The coupling portion 31 may be formed as one member with the body section 10.

The back-side supporting portion 32 supports the trailing edge 74 of the rotor blade member 70 from the back side. In the second pressing section 30, the back-side supporting portion 32 presses the trailing edge 74 of the rotor blade member 70 from the back side with the reaction forces of the pressing forces of the third pressing section 40 and the fourth pressing section 50 to be described below. The butting portion 33 protrudes in the second direction D2 from the back-side supporting portion 32. The butting portion 33 is capable of butting a tip of the trailing edge 74 of the rotor blade member 70. By butting the tip of the trailing edge 74 against the butting portion 33, it is possible to position the rotor blade member 70 in the first direction D1.

The circular-arc portion 35 is disposed at the tip of the butting portion 33 in the protruding direction, and is disposed in a circular-arc shape around the central axis AX. The circular-arc portion 35 is disposed at a position that overlaps a circular-arc portion 42 of the third pressing section 40 to be described below as viewed from the third direction D3. Additionally, the circular-arc portion 35 movably supports the fourth pressing section 50 at the tip 35*a* in a circular-arc direction.

A guide portion 34 is inserted into a first elongated hole 42*a* of the third pressing section 40 to be described below, and guides the pivoting of the third pressing section 40. The guide portion 34 is, for example, a projection portion that protrudes in the third direction D3 from the circular-arc portion 35.

The third pressing section 40 has a linear portion 41 that is linear, and a circular-arc portion 42 having a circular-arc shape. Although the linear portion 41 and the circular-arc portion 42 are formed of, for example, one member, the invention is not limited to this, and a configuration may be adopted in which separate members are integrally coupled to each other by a coupling member or the like.

The linear portion 41 has one end pivotably supported by the pivot shaft 13 and the other end connected to the circular-arc portion 42. The linear portion 41 is supported to be pivotable around the central axis AX by the pivot shaft 13 of the body section 10. As the linear portion 41 pivots around the central axis AX, the linear portion 41 and the circular-arc portion 42 pivot integrally. The linear portion 41 has an elongated hole 41*a*. The elongated hole 41*a* is formed, for example, in the longitudinal direction of the linear portion 41, and passes through the linear portion 41 in the third direction D3. An insertion portion 64 of the pressing force application portion 60 is inserted into the elongated hole 41*a* to be described below.

One end of the circular-arc portion 42 in the circular-arc direction is connected to the linear portion 41 on the back side of the rotor blade member 70. The other end of the circular-arc portion 42 in the circular-arc direction is disposed on a belly side of the rotor blade member 70. The circular-arc portion 42 is disposed to bypass the trailing edge 74 of the rotor blade member 70 from one end to the other end in the circular-arc direction. In this way, the circular-arc portion 42 is disposed to bypass the trailing edge 74 from the back side of the rotor blade member 70 to the belly side thereof.

The circular-arc portion 42 has the first elongated hole 42*a* and a second elongated hole 42*b*. The first elongated hole 42*a* is disposed in the circular-arc direction of the circular-arc portion 42, and passes through the circular-arc portion 42 in the third direction D3. The above guide portion 34 is inserted into the first elongated hole 42*a*. In a case where the third pressing section 40 pivots around the central axis AX as the guide portion 34 pivots in the first elongated hole 42*a*, the pivoting of the circular-arc portion 42 is guided by the guide portion 34.

The second elongated hole 42*b* is disposed in the circular-arc direction of the circular-arc portion 42, and passes between an outer circumferential surface 42*c* and an inner circumferential surface 42*d* of the circular-arc portion 42. The circular-arc portion 35 of the second pressing section 30 is inserted into the second elongated hole 42*b*. By providing the second elongated hole 42*b*, the third pressing section 40 is pivotable around the central axis AX without interfering with the circular-arc portion 35.

In the third pressing section 40, as the circular-arc portion 42 pivots around the central axis AX, a tip of the circular-arc portion 42 in the circular-arc direction presses a portion between the leading edge 73 and the trailing edge 74 of the rotor blade member 70 from a belly portion 72 side (hereinafter written as the "belly side"). A pressing direction of the third pressing section 40 is opposite to that of the first pressing section 20 and the second pressing section 30. As the third pressing section 40 pressing the rotor blade member 70 from the belly side, the first pressing section 20 and the second pressing section 30 press the rotor blade member 70 from the back side with the reaction forces.

The fourth pressing section 50 is formed in the second pressing section 30, and presses the trailing edge 74 of the rotor blade member 70 from the belly side to sandwich the trailing edge 74 between the fourth pressing section and the second pressing section 30. The fourth pressing section 50 is supported by a tip of the circular-arc portion 35 of the second pressing section 30. The fourth pressing section 50 is provided through the circular-arc portion 35 in a radial direction (a direction towards the central axis AX) of the circular-arc portion 35. The fourth pressing section 50 is movable in the radial direction of the circular-arc portion 35.

The fourth pressing section 50 has an abutment portion 51, a penetration portion 52, and an operation portion 53. The abutment portion 51 abuts against the trailing edge 74 of the rotor blade member 70 from the belly side. The penetration portion 52 is connected to the abutment portion 51, and passes through the circular-arc portion 35. The penetration portion 52 is disposed to protrude radially outward of the circular-arc portion 35. The penetration portion 52 has a screw part at a portion that passes through the inside of the circular-arc portion 35. Additionally, a screw part corresponding to the screw part is disposed inside the circular-arc portion 35. That is, the penetration portion 52 is screwed to the circular-arc portion 35. The operation portion 53 is formed at a radially outer end portion of the penetration portion 52. The operation portion 53 is formed integrally with the penetration portion 52. The operation portion 53 is rotatable around a central axis of the penetration portion 52. The penetration portion 52 is insertable into and removable from the circular-arc portion 35 by rotating the operation portion 53. By inserting and removing the penetration portion 52 into and from the circular-arc portion 35, a position between the abutment portion 51 and the trailing edge 74 of the rotor blade member 70 is adjustable. Hence, by rotating the operation portion 53, it is possible to press the trailing edge 74 with the abutment portion 51 to sandwich the trailing edge between the abutment portion and the back-side supporting portions 32 of the second pressing section 30.

The pressing force application portion 60 is formed in the body section 10, and applies a pressing force to the third pressing section 40. As the pressing force application portion 60, for example, an air cylinder or the like is used. The pressing force application portion 60 has a cylinder 61, a piston rod 62, a moving portion 63, and an insertion portion 64. The cylinder 61 is detachably attached to the attachment port 14 of the body section 10. The cylinder 61 has an air flow passage 61*a* through which air for adjusting internal pressure flows. The air flow passage 61*a* is connected to an air drive mechanism (not illustrated). The air drive mechanism is capable of adjusting the pressure in the cylinder 61. In addition, when a plurality of the application jigs 100 are arranged side by side in the blade length direction with respect to one rotor blade member 70, for example, a manifold portion capable of supplying air to a plurality of the cylinders 61 may be provided. A piston (not illustrated) is provided inside the cylinder 61. The piston moves in an axial direction of the cylinder 61 due to fluctuation of the pressure in the cylinder 61. In the present embodiment, although a case where the axial direction of the cylinder 61 is parallel to the second direction D2 is described as an example, the invention is not limited to this.

The piston rod 62 is integrally coupled to the piston inside the cylinder 61. The piston rod 62 moves in the second direction D2 integrally with the piston. The moving portion 63 is integrally coupled to the piston rod 62. The moving portion 63 moves in the second direction D2 integrally with the piston and the piston rod 62. The insertion portion 64 is a projection portion that protrudes in the third direction D3 from the moving portion 63. The insertion portion 64 is inserted into the elongated hole 41*a* of the linear portion 41 of the third pressing section 40. As the insertion portion 64 is inserted into the elongated hole 41*a*, the moving portion 63 is coupled to the third pressing section 40. Hence, in a case where the piston rod 62 moves in a protruding direction, the insertion portion 64 presses the linear portion 41. As the linear portion 41 is pressed, the linear portion 41 and the circular-arc portion 42 of the third pressing section 40 pivots integrally in a direction around the central axis AX. Due to this pivoting, the tip of the circular-arc portion 42 in the circular-arc direction abuts against the rotor blade member 70, and presses the rotor blade member 70 from the belly side. In this way, the pressing force application portion 60 applies the pressing force to the third pressing section 40.

Figure 3:
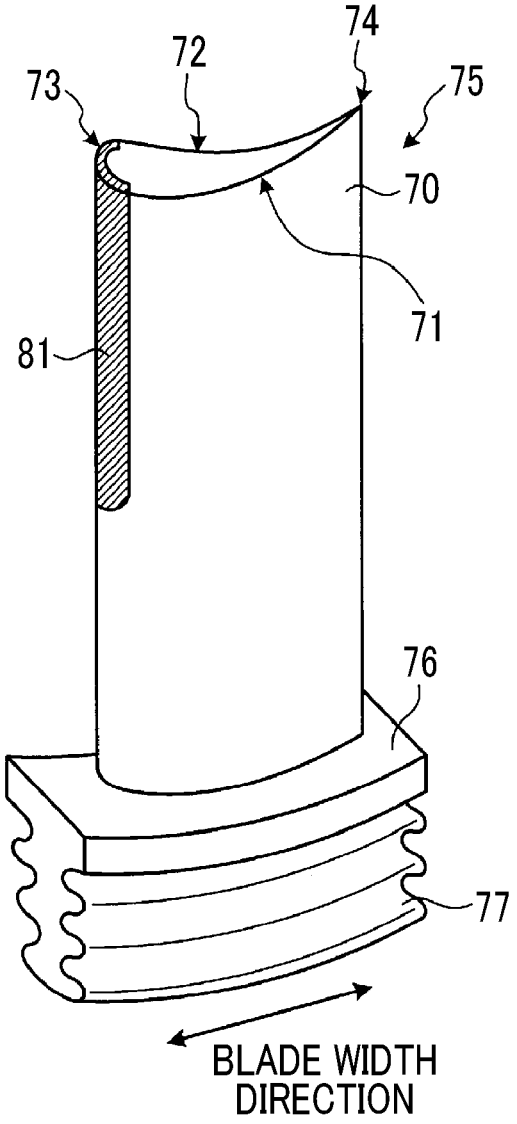
FIG. 3 is a view illustrating an example of a rotor blade according to the present embodiment.

FIG. 3 is a schematic view illustrating the rotor blade 75 according to the present embodiment. As illustrated in FIG. 3, the rotor blade 75 includes a blade root portion 76, a platform 77, and the rotor blade member 70. The blade root portion 76 is buried, for example, in a rotor disk of a rotor of a steam turbine, and the rotor blade 75 is fixed to the rotor disk. The platform 77 has a curved plate-shaped object integrated with the blade root portion 76. In the rotor blade member 70, a base end portion is fixed to the platform 77 and a tip portion extends to, for example, an inner wall surface side of a casing of the steam turbine.

A front surface of the rotor blade member 70 is a curved surface. An erosion shield 81 is formed at a portion of the front surface of the rotor blade member 70. The erosion shield 81 is formed at a portion of the leading edge 73 on an upstream side of a steam current, in the rotor blade 75 when the rotor blade 75 rotates and the steam current flows. As the erosion shield 81, for example, a cobalt-based alloy having cobalt as a main component can be used.

Figure 4:
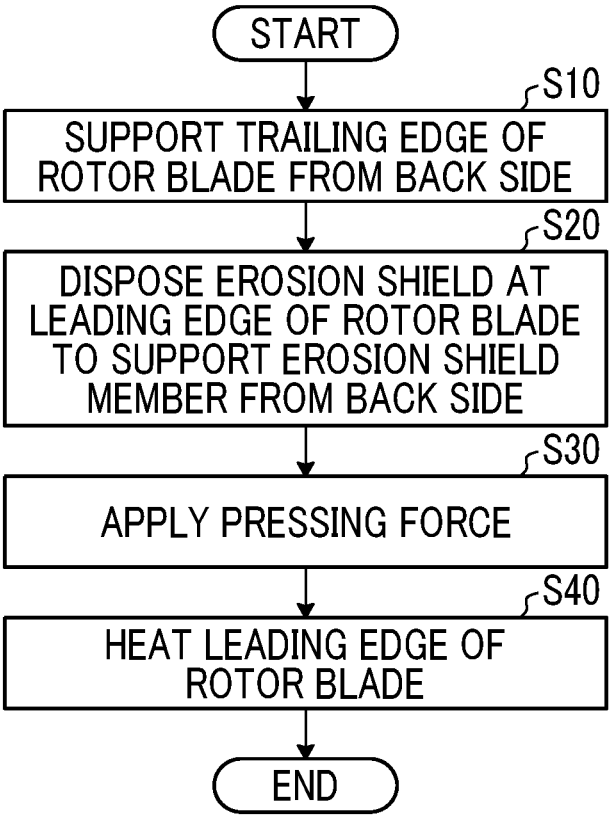
FIG. 4 is a flowchart illustrating an example of a method for manufacturing rotor blades according to the present embodiment.

Next, a method for manufacturing the rotor blade 75 in which the erosion shield member 80 is applied to the rotor blade member 70 by using the application jig 100 configured as described above will be described. FIG. 4 is a flowchart illustrating an example of the method for manufacturing the rotor blade member 70 according to the present embodiment. FIGS. 5 to 9 are views illustrating one step of the method for manufacturing the rotor blade member 70 according to the present embodiment. In the method for manufacturing the rotor blade 75 according to the present embodiment, for example, a plurality of the application jigs 100 are arranged side by side in the blade length direction respect to one rotor blade member 70. Although one application jig 100 is described as an example in the following description, the same description is also applicable to the other application jigs 100.

Figure 5:
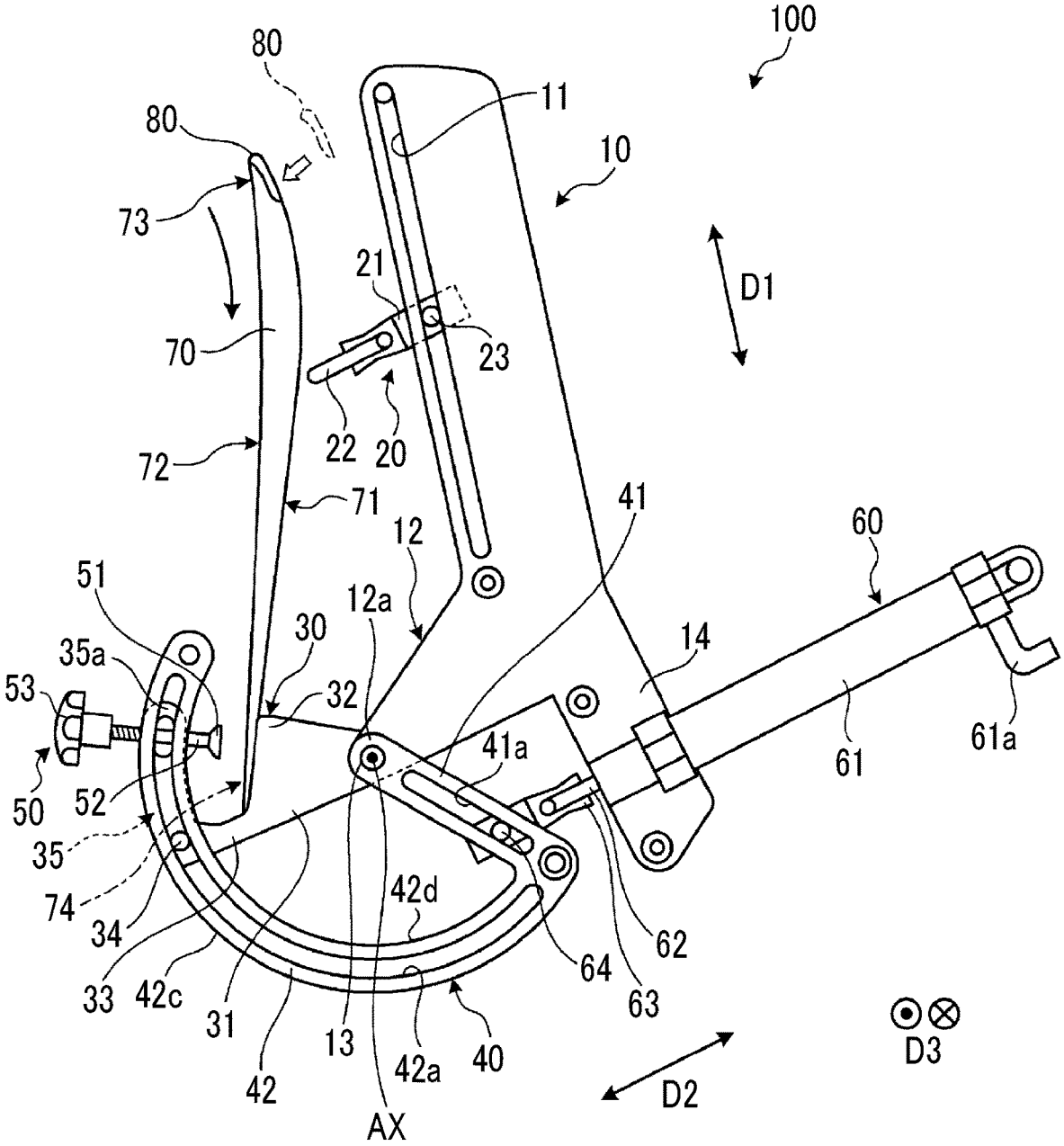
FIG. 5 is a view illustrating one step of the method for manufacturing rotor blades according to the present embodiment.

As illustrated in FIGS. 4 and 5, first, the trailing edge 74 of the rotor blade member 70 is supported from the back side by the second pressing section 30 (Step S10). In Step S10, as illustrated in FIG. 5, the third pressing section 40 and the fourth pressing section 50 are separated from the back-side supporting portion 32 of the second pressing section 30. In this state, the back-side supporting portion 32 is disposed on the back side 71 of the trailing edge 74 in a state the back portion 71 of the rotor blade member 70 is directed to the body section 10 side. The tip of the trailing edge 74 of the rotor blade member 70 is butted against, for example, the butting portion 33. In addition, prior to Step S10, the erosion shield member 80 is to be placed at the leading edge 73 of the rotor blade member 70.

Figure 6:
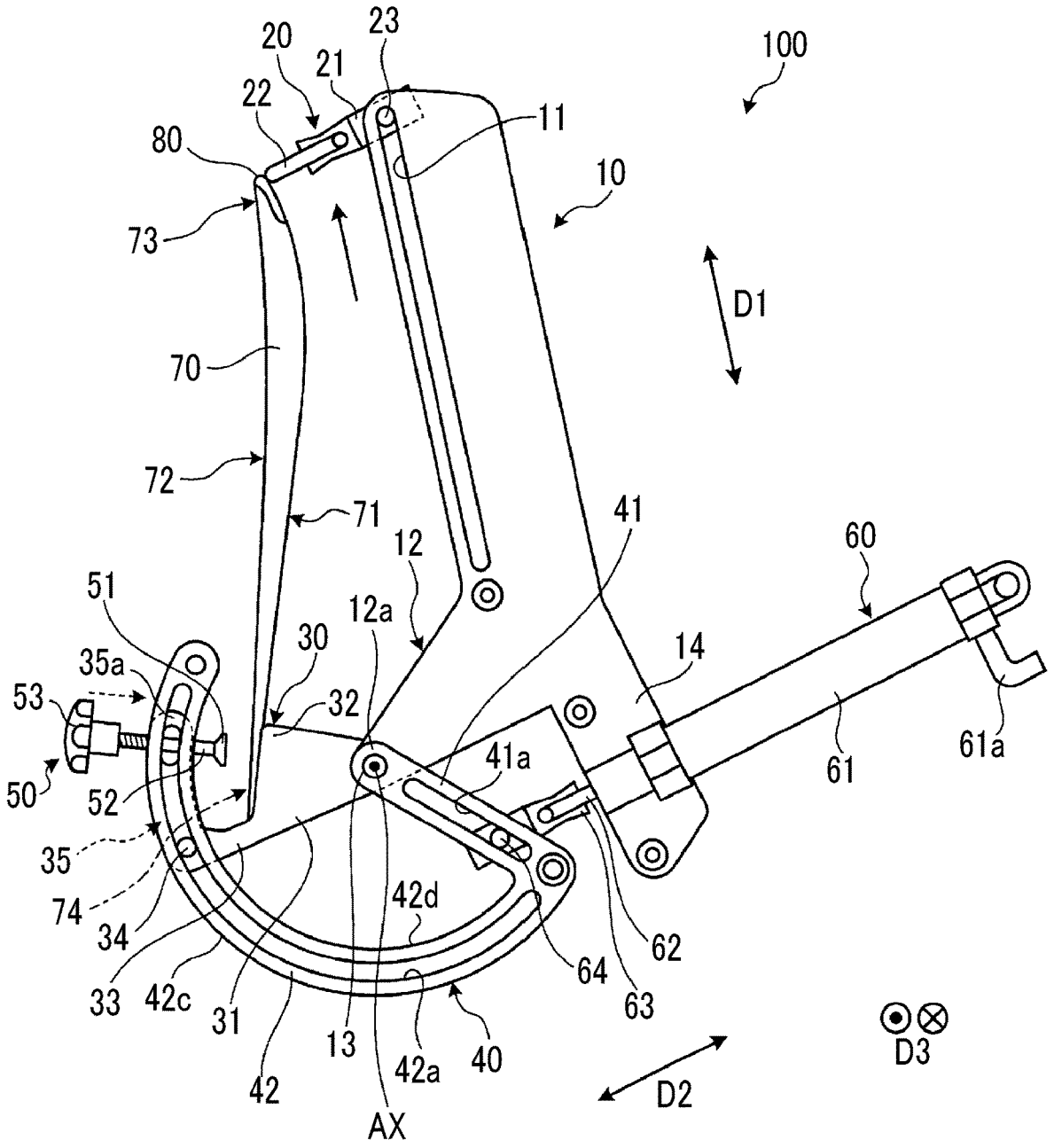
FIG. 6 is a view illustrating one step of the method for manufacturing rotor blades according to the present embodiment.

Next, as illustrated in FIGS. 4 and 6, the erosion shield member 80 is supported from the back side of the rotor blade member 70 by the first pressing section 20 (Step S20). In Step S20, as illustrated in FIG. 6, the first pressing section 20 is moved along the guide portion 11, and the position of the first pressing section 20 is adjusted. The position of the first pressing section 20 is, for example, a position where a tip of the abutment portion 22 abuts against the erosion shield member 80. After the position of the first pressing section 20 is adjusted, a nut is fastened to the insertion portion 23, and the first pressing section 20 is fixed to the body section 10. Accordingly, the first pressing section 20 is positioned. In addition, before a pressing force is applied by the first pressing section 20, the trailing edge 74 of the rotor blade member 70 may be sandwiched between the fourth pressing section 50 and the second pressing section 30 by the fourth pressing section 50. In this case, by rotating the operation portion 53, the abutment portion 51 is moved to the trailing edge 74 side, and the trailing edge 74 is pressed against the back-side supporting portion 32 side of the second pressing section 30 by the abutment portion 51 (refer to a dotted line arrow of FIG. 6). Accordingly, the rotor blade member 70 is fixed. In addition, the fourth pressing section 50 may not be used.

Figure 7:
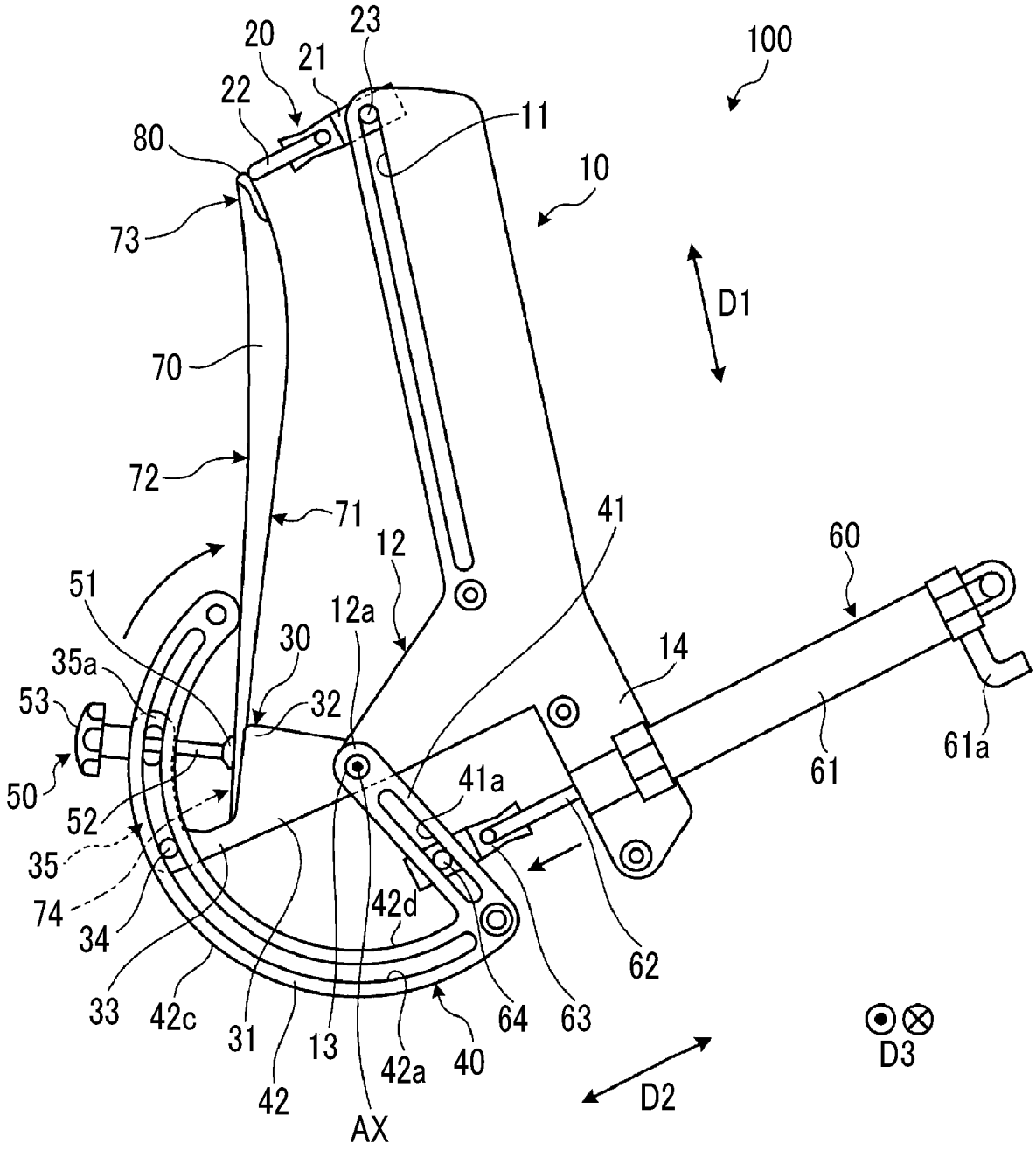
FIG. 7 is a view illustrating one step of the method for manufacturing rotor blades according to the present embodiment.

Next, as illustrated in FIGS. 4 and 7, by pressing the portion between the leading edge 73 and the trailing edge 74 of the rotor blade member 70 from the belly side with the third pressing section 40 in a state where the rotor blade member 70 is supported by the first pressing section 20 and the second pressing section 30, the rotor blade member 70 is pressed in a sandwiched state together with the first pressing section 20 and the second pressing section 30 (Step S30). In Step S30, as illustrated in FIG. 7, by increasing the pressure in the cylinder 61 with the air drive mechanism (not illustrated), the piston rod 62 moves in a direction in which the piston rod protrudes from the cylinder 61 integrally with the moving portion 63. Due to the movement of the moving portion 63, the insertion portion 64 presses the linear portion 41 of the third pressing section 40, and the linear portion 41 and the circular-arc portion 42 pivot in the direction around the central axis AX. Due to this pivoting, a tip of the circular-arc portion 42 abuts against the portion between the leading edge 73 and the trailing edge 74 of the rotor blade member 70 from the belly side, and presses the rotor blade member 70 from the belly side. The rotor blade member 70 is pushed to the first pressing section 20 and second pressing section 30 side by the pressing of the third pressing section 40. The first pressing section 20 and the second pressing section 30 are supported by the body section 10. For this reason, the rotor blade member 70 receives the reaction forces from the first pressing section 20 and the second pressing section 30. The first pressing section 20 and the second pressing section 30 press the rotor blade member 70 from the back side due to the reaction forces. Hence, the rotor blade member 70 is pressed in a sandwiched state from the back side by the first pressing section 20 and the second pressing section 30 and from the belly side by third pressing section 40.

Figure 8:
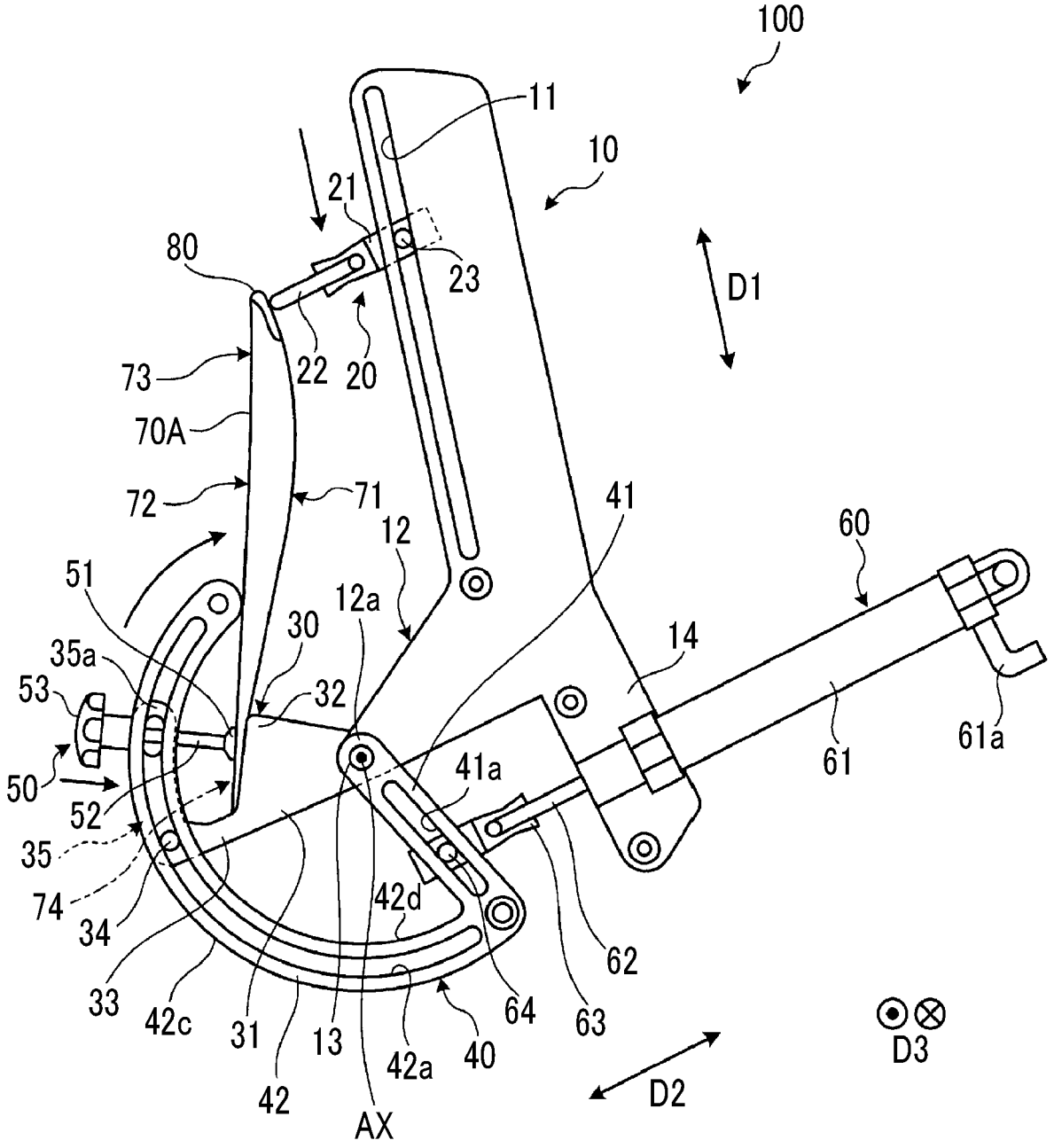
FIG. 8 is a view illustrating one step of the method for manufacturing rotor blades according to the present embodiment.

Additionally, in a case where the erosion shield member 80 is applied to a rotor blade member 70A having different dimensions in a blade width direction, as illustrated in FIG. 8, the position of the first pressing section 20 in the first direction D1 can be adjusted. Accordingly, the erosion shield member 80 can be pressed at a position corresponding to a dimension in the blade width direction eve for the rotor blade member 70A having different dimensions in the blade width direction.

Figure 9:
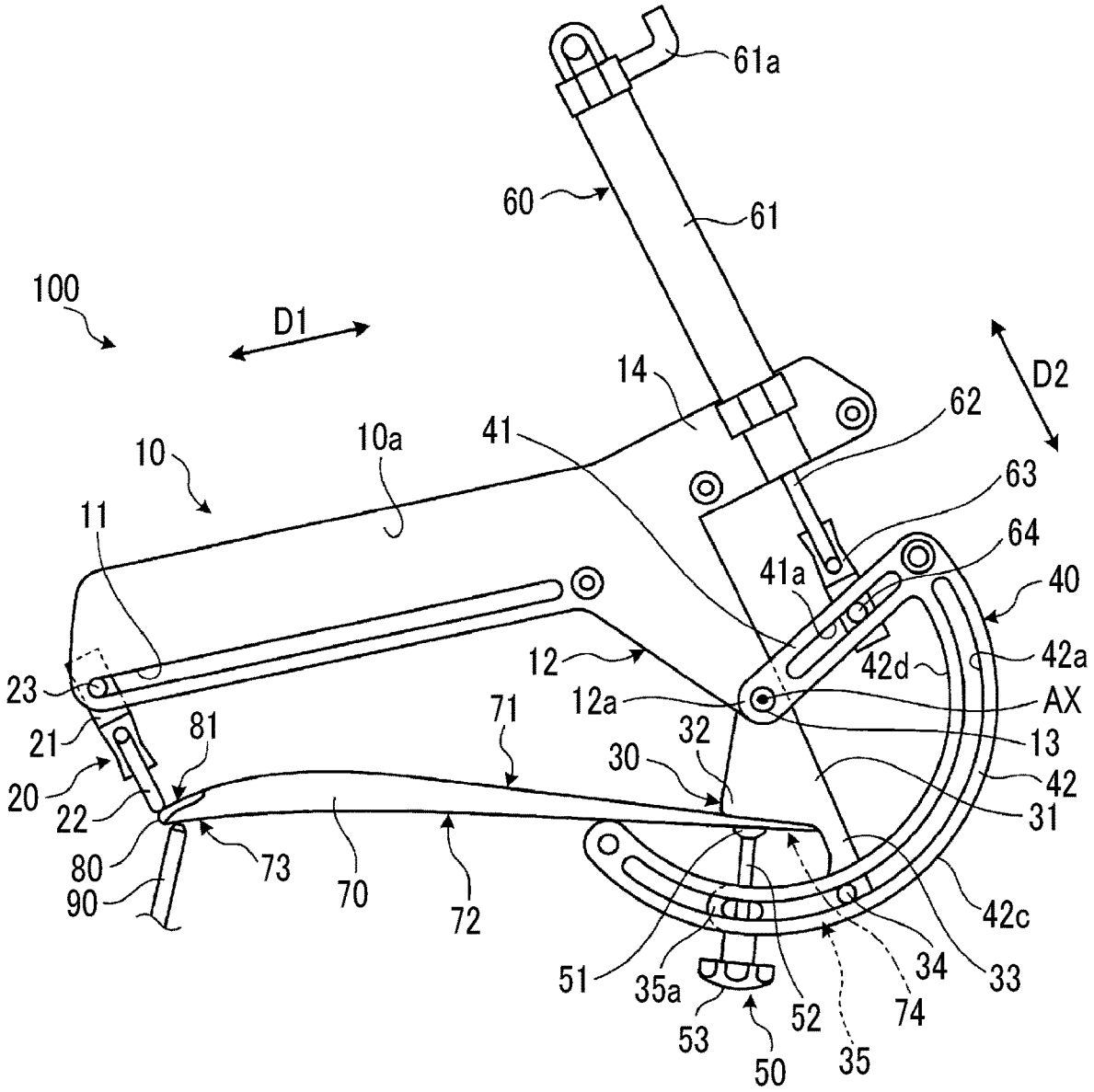
FIG. 9 is a view illustrating one step of the method for manufacturing rotor blades according to the present embodiment.

Next, as illustrated in FIGS. 4 and 9, the erosion shield member 80 is applied to the leading edge 73 of the rotor blade member 70 by heating the leading edge 73 of the rotor blade member 70 from the belly side in a state where the rotor blade member 70 is pressed by the first pressing section 20, the second pressing section 30, and the third pressing section 40. In Step S40, as illustrated in FIG. 9, the leading edge 73 of the rotor blade member 70 is heated from the belly side by using a heating instrument 90. As the heating instrument 90, for example, a heating torch or the like is used. Combustion gas is jetted from the belly side to the leading edge 73 of the rotor blade member 70 by the heating instrument 90, and the leading edge 73 is heated. In the present embodiment, since the third pressing section 40 is disposed to bypass the trailing edge 74 from the back side of the rotor blade member 70 to the belly side thereof, any interference between the heating instrument 90 and the application jig 100 is suppressed when the leading edge 73 is heated from the belly side. For this reason, workability can be improved. Due to Step S40, the leading edge 73 is heated, and the erosion shield member 80 is welded to the leading edge 73 of the rotor blade member 70. Accordingly, the rotor blade 75 in which the erosion shield 81 is formed at the leading edge 73 can be obtained.

As described above, the application jig 100 according to the present embodiment is the application jig 100 that is used when the erosion shield member 80 is applied to the rotor blade member 70, and includes the body section 10 that is disposed on the back side of the rotor blade member 70, the first pressing section 20 that is provided in the body section 10 and presses the erosion shield member 80 to be placed at the leading edge 73 of the rotor blade member 70 from the back side of the rotor blade member 70, the second pressing section 30 that is supported by the body section 10 and presses the trailing edge 74 of the rotor blade member 70 from the back side, and the third pressing section 40 that is supported by the body section 10, is disposed to bypass the trailing edge 74 from the back side of the rotor blade member 70 to the belly side thereof, is pivotable around the pivot shaft 13 provided in the body section 10, and presses the portion between the leading edge 73 and the trailing edge 74 of the rotor blade member 70 from the belly side.

Therefore, since the first pressing section 20 presses the leading edge 73 from the back side and the third pressing section 40 is disposed to bypass the trailing edge 74 from the back side of the rotor blade member 70 to the belly side thereof, the belly side of the leading edge 73 in which the erosion shield member 80 is disposed is not blocked by the application jig 100. Accordingly, the workability when the leading edge 73 is heated using the heating instrument 90 can be improved. Additionally, as the third pressing section 40 presses the rotor blade member 70 from the belly side, the rotor blade member 70 can be sandwiched and held from the belly side and the back side between the first pressing section 20 and the second pressing section 30 that press the rotor blade member 70 from the back side. In this case, since the third pressing section 40 presses the portion between the leading edge 73 and the trailing edge 74 of the rotor blade member 70 from the belly side, the rotor blade member 70 can be pressed in a balanced manner by minimum pressing parts. Moreover, since the third pressing section 40 is pivotable around the pivot shaft 13 provided in the body section 10 and performs pressing in a pivoting direction, the rotor blade member 70 having a curved surface can also be reliably and easily pressed in accordance with the position of the curved surface.

Additionally, in the application jig 100 according to the present embodiment, the first pressing section 20 is supported to be movable in the blade width direction of the rotor blade member 70. Therefore, the rotor blade member 70 having different dimensions in the blade width direction can also be used.

Additionally, the application jig 100 according to the present embodiment includes the pressing force application portion 60 that is provided in the body section 10 and applies the pressing force to the third pressing section 40. Therefore, pressing forces can be efficiently generated in the first pressing section 20, the second pressing section 30, and the third pressing section 40 by applying the pressing force to the third pressing section 40.

Additionally, in the application jig 100 according to the present embodiment, the pressing force application portion 60 is an air cylinder. Therefore, the control of the pressing forces can be stably performed.

Additionally, in the application jig 100 according to the present embodiment, the third pressing section 40 is a circular-arc member. Therefore, since the shape of the third pressing section 40 is a circular-arc shape corresponded to a track during pivoting, a space where the third pressing section 40 pivots can be stopped.

Additionally, the application jig 100 according to the present embodiment further includes the fourth pressing section 50 that is provided in the second pressing section 30, presses the trailing edge 74 of the rotor blade member 70 from the belly side, and sandwiches the trailing edge 74 between the fourth pressing section and the second pressing section 30. Therefore, the rotor blade member 70 can be stably held.

Additionally, in the application jig 100 according to the present embodiment, the second pressing section 30 has a guide portion 34 that guides the pivoting of the third pressing section 40. Therefore, the pivoting of the third pressing section 40 can be stabilized, and the pressing forces that press the rotor blade member 70 can be stabilized.

The method for manufacturing rotor blades according to the present embodiment is a method for manufacturing the rotor blade 75 that manufactures the rotor blade 75, using the above application jig 100, and includes a step of supporting the trailing edge 74 of the rotor blade member 70 from the back side with the second pressing section 30, a step of placing the erosion shield member 80 at the leading edge 73 of the rotor blade member 70 and supporting the erosion shield member 80 from the back side of the rotor blade member 70 with the first pressing section 20, a step of pressing the rotor blade member 70 in a sandwiched state together with the first pressing section 20 and the second pressing section 30 by pressing the portion between the leading edge 73 and the trailing edge 74 of the rotor blade member 70 from the belly side with the third pressing section 40 in a state where the rotor blade member 70 is supported by the first pressing section 20 and the second pressing section 30, and a step of applying the erosion shield member 80 to the leading edge 73 of the rotor blade member 70 by heating the leading edge 73 of the rotor blade member 70 from the belly side in a state where the rotor blade member 70 is pressed by the first pressing section 20, the second pressing section 30, and the third pressing section 40 (Step S40). Therefore, the belly side of the leading edge 73 in which the erosion shield member 80 is disposed is not blocked by the application jig 100. Accordingly, the workability when the leading edge 73 is heated using the heating instrument 90 can be improved.

The technical scope of the invention is not limited to the above embodiment, and changes can be appropriately made without departing the spirit of the invention. For example, in the above embodiment, a configuration in which the air cylinder is used as the pressing force application portion 60 has been described as an example. However, the invention is not limited to this. Other components may be used as the pressing force application portion 60 as long as components, such as a spring and, a ball screw mechanism, in which the pressing force can be applied to the third pressing section 40, can be adopted.

REFERENCE SIGNS LIST

10: body section
10*a*: through-hole
11, 35: guide portion
12: protrusion portion
12*a*: bearing portion
13, 16: pivot shaft
14: attachment port
20: first pressing section
21: base portion
22, 51: abutment portion
23, 64: insertion portion
30: second pressing section
31: coupling portion
32: back-side supporting portion
33: butting portion
34: guide portion
35, 42: circular-arc portion
40: third pressing section
41: linear portion
41*a*: elongated hole
42*a*: first elongated hole
42*b*: second elongated hole
42*c*: outer circumferential surface
42*d*: inner circumferential surface
50: fourth pressing section
52: penetration portion
53: operation portion
60: pressing force application portion
61: cylinder
61*a*: air flow passage
62: piston rod
63: moving portion
70, 70A: rotor blade member
71: back portion
74: trailing edge
72: belly portion
73: leading edge
75: rotor blade
76: blade root portion
77: platform
80: erosion shield member
81: erosion shield
90: heating instrument
100: application jig
D1: first direction
D2: second direction
D3: third direction
AX: central axis

The invention claimed is:

1. An application jig used when an erosion shield member is applied to a rotor blade member, the application jig comprising:

a body section that is disposed on a back side of the rotor blade member;

a first pressing section that is provided in the body section and presses an erosion shield member to be placed at a leading edge of the rotor blade member from the back side of the rotor blade member;

a second pressing section that is supported by the body section and presses a trailing edge of the rotor blade member from the back side; and a third pressing section that is supported by the body section, is disposed to bypass the trailing edge from the back side of the rotor blade member to a belly side thereof, is pivotable around a pivot shaft provided in the body section, and presses a portion between the leading edge and the trailing edge of the rotor blade member in a pivoting direction from the belly side.

2. The application jig according to claim 1, wherein the first pressing section is supported to be movable in a blade width direction of the rotor blade member.

3. The application jig according to claim 1, further comprising:

a pressing force application portion that is provided in the body section and applies a pressing force to the third pressing section.

4. The application jig according to claim 3, wherein the pressing force application portion is an air cylinder.

5. The application jig according to claim 1, wherein the third pressing section is a circular-arc member.

6. The application jig according to claim 1, further comprising:

a fourth pressing section that is provided in the second pressing section, presses the trailing edge of the rotor blade member from the belly side, and sandwiches the trailing edge between the fourth pressing section and the second pressing section.

7. The application jig according to claim 6, wherein the second pressing section has a guide portion that guides the pivoting of the third pressing section.

8. A method for manufacturing rotor blades by using the application jig according to claim 1, the method comprising:

supporting the trailing edge of the rotor blade member from the back side with the second pressing section;

placing the erosion shield member at the leading edge of the rotor blade member and supporting the erosion shield member from the back side of the rotor blade member with the first pressing section;

pressing the rotor blade member in a sandwiched state together with the first pressing section and the second pressing section by pressing the portion between the leading edge and the trailing edge of the rotor blade member from the belly side with the third pressing section in a state where the rotor blade member is supported by the first pressing section and the second pressing section; and applying the erosion shield member to the leading edge of the rotor blade member by heating the leading edge of the rotor blade member from the belly side in a state where the rotor blade member is pressed by the first pressing section, the second pressing section, and the third pressing section.

* * * * *